United States Patent [19]

Seemann et al.

[11] 4,168,950

[45] Sep. 25, 1979

[54] FURNACE WALL CONSTRUCTION

[75] Inventors: Howard H. Seemann, North Wales; George J. Ochsenreither, Jr., Hatboro, both of Pa.

[73] Assignee: Selas Corporation of America, Dresher, Pa.

[21] Appl. No.: 770,850

[22] Filed: Feb. 22, 1977

Related U.S. Application Data

[63] Continuation of Ser. No. 596,610, Jul. 17, 1975, abandoned.

[51] Int. Cl.[2] ..... F23D 13/12; F23D 13/46

[52] U.S. Cl. ..... 431/348; 432/175; 60/39.69 R

[58] Field of Search ..... 431/348, 347, 329, 181–188; 110/1 A, 317, 1 B; 432/175; 60/39.69

[56] References Cited

U.S. PATENT DOCUMENTS

| | | | |
|---|---|---|---|
| 2,669,300 | 2/1954 | Blaha | 431/348 |
| 2,904,108 | 9/1959 | Blaha | 431/348 |
| 3,118,807 | 1/1964 | Holcomb | 110/317 |
| 3,199,570 | 8/1965 | Williams et al. | 431/348 |
| 3,212,554 | 10/1965 | Blaha | 432/175 |
| 3,692,460 | 9/1972 | Morck | 431/348 |
| 3,868,212 | 2/1975 | Lemaire | 432/175 |
| 4,039,280 | 8/1977 | Kienow et al. | 110/1 B |

OTHER PUBLICATIONS

A Concise Encyclopaedia-of Metallurgy, 1965, pp. 822–825.

*Primary Examiner*—Henry C. Yuen
*Attorney, Agent, or Firm*—Miller & Prestia

[57] ABSTRACT

The invention is directed to a fibrous and substantially non-porous shield that is placed around a burner block in a furance wall in order to prevent the flow of combustion gases or combustible gases back from the block to the casing of the furnace wall where they could burn and damage said casing.

5 Claims, 1 Drawing Figure

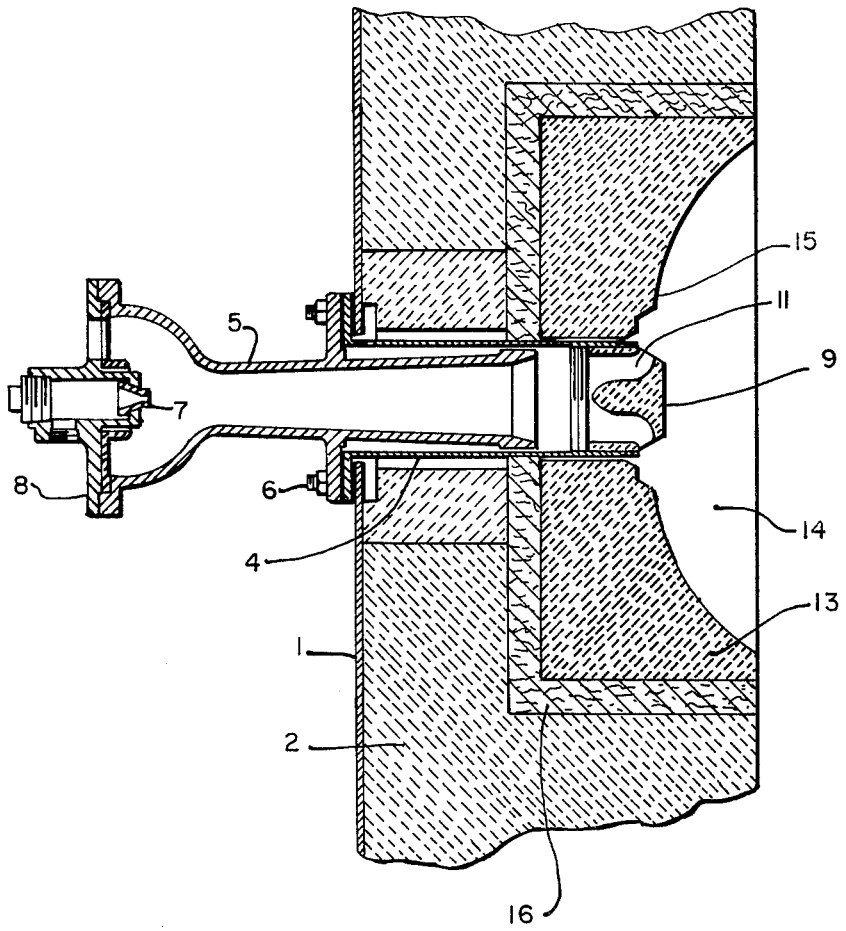
15
11
9
5
7
8
6
4
14
13
1
2
16

FURNACE WALL CONSTRUCTION

This application is a continuation of Ser. No. 596,610, filed July 17, 1975 and now abandoned.

BACKGROUND OF INVENTION

The present invention relates to industrial furnaces, and more particularly to means for protecting the casing of a furnace.

From time to time during the operation of industrial furnaces, and for various reasons, the burner blocks that are located in the furnace lining will crack. When this occurs it is not unusual for a combustible mixture of gas and air to flow backward from the front of the burner through the cracks in the block and refractory lining to burn along the outer surface of the lining and casing. When this occurs the furnace casing is damaged and the furnace refractory lining is damaged.

Gases can also flow in the other direction into the furnace, depending upon furnace pressure. Inward flow introduces excess air into the furnace at the burner to produce a change in flame characteristic from that desired. The flow is uncontrolled since the size of the cracks is indefinite and varies with time and furnace operation.

Various means of insulating and caulking around the back of burner blocks have been tried to prevent the flow of gases, without much success.

SUMMARY OF THE INVENTION

In practicing the present invention, the burner block is located as usual in the furnace lining. In constructing the furnace there is provided a shield of fibrous material into which the burner block is fitted. The block and shield are then built into the furnace lining. This shield is constructed of a fibrous material which will withstand high temperatures, such as silicon oxide, and aluminum oxide and a binder. The fibers are moulded into a shield having an internal shape to receive snugly the burner block and an external shape that can be incorporated easily into the refractory of the furnace lining. The fibrous shield surrounding the burner block will prevent any flow of gases to or from the furnace face of the block. Thus, leakage of combustible gas from or oxygen to the furnace interior cannot take place, no matter how badly the burner block may crack.

It is an object of the invention to provide a means to isolate a burner block from the remainder of the furnace lining in such a fashion that cracks in the burner block will have no effect on the operation of the burner or furnace in which it is used.

The various features of novelty which characterize our invention are pointed out with particularity in the claims annexed to and forming a part of this specification. For a better understanding of the invention, however, its advantages and specific objects attained with its use, reference should be had to the accompanying drawings and descriptive matter in which we have illustrated and described a preferred embodiment of the invention.

IN THE DRAWINGS

The single FIGURE of drawing shows, in section, a portion of a furnace wall constructed in accordance with the applicants invention.

Referring to the drawing, there is shown at 1 a portion of the sheet metal casing of a furnace wall. The casing backs up refractory 2 of which the wall lining is formed. This refractory may be either brick or cast as desired. Both the casing and lining are provided with an opening through which a burner extends. As shown herein, for example, the burner is a venturi burner of the radiant cup variety. Such a burner includes a cylindrical tip holder 4 which along with a venturi 5 is bolted at 6 to the casing. The venturi supports a spud 7 through which fuel is supplied and an air shutter 8. A distributor tip 9 is threaded into the inner end of holder 4. Fuel and air are discharged through passages 11 in the tip in a substantially radial direction.

The front end of tip holder 4 extends through an opening in a burner block 13. This block may be circular or rectangular in shape and is built into the refractory 2. As shown, the block is provided with a cup-shaped depression 14 in its inner face that is formed with a concentric step 15 adjacent to the opening receiving the tip holder. It is noted that tip 9 projects into the base of the cup so that fuel mixture discharged through passages 11 is directed substantially parallel to the cup surface.

Block 13 is surrounded by and separated from refractory 2 by a shield 16. This shield is composed of ceramic fibers such as a combination of silica oxide and aluminum oxide. In making the shield, the fibers are mixed with a binder such as colloidal silica and water. A starch may also be used as an initial binder. The mixture is cast or preferably vacuum molded around a form corresponding in size and shape to the exterior of burner block 13. After the shield is removed from the form it is baked at about 500° F. (260° C.) to dry it out and set the binder. The starch, if used, is burned out during this drying. The shield is made from one to two inches thick and receives the block with a sliding fit. The drawing illustrates a burner block that has a thickness about half the thickness of the lining. It will be apparent, however, that the furnace lining can be thin enough so that the back of shield 16 abuts the casing 1.

When the moulded shield is dried, it is substantially non-porous and is completely non-porous or impermeable when subjected to pressures across its thickness somewhat greater than those encountered in the operation of industrial furnaces. Such pressures seldom exceed one half inch of water pressure. The shield will be unaffected by temperatures up to 2300° F. In constructing a furnace wall, the shield is built or cast into the refractory lining structure. The burner block is then placed in the cavity of the shield. It is preferably held in place by conventional anchor bolts, although it can be cemented in place.

The shield 16 may be built into a furnace lining when the furnace is initially constructed. It may also be used to repair an existing furnace. In the latter case, a furnace block and a portion of the existing refractory are removed. The shield is then inserted in position and the furnace block put in the shield. The parts are cemented or otherwise fastened together.

The fibrous nature of shield 16 insures that it will not crack even though cracks may develop in the burner block or other refractory of the furnace lining. Thus, there is no possibility for a combustible gas mixture or combustion gases to flow back through cracks in the burner block to damage the furnace casing or adjacent piping. As a matter of fact, any gases flowing through cracks in a burner block will flow back between the shield and the edge of the block into the furnace chamber.

While in accordance with the provisions of the Statutes we have illustrated and described the best form of embodiment of our invention now known to us, it will be apparent to those skilled in the art that changes may be made in the form of the apparatus disclosed without departing from the spirit and scope of the invention set forth in the appended claims, and that in some cases certain features of our invention may be used to advantage without a corresponding use of other features.

What is claimed is:

1. In an industrial furnace, the combination of a furnace casing, a furnace lining consisting of a refractory construction having one surface adjacent to said casing and an opposed surface forming a wall of a furnace chamber, said opposed surface having a recess of a shape to receive a burner block therein, a burner block in said recess, and a temperature resistant shield in the form of a moulded cup-shaped body of fibrous ceramic material and a binder, the material of said body being uneffected by temperatures up to 2300° F., and said body being formed with an open end adapted to receive said burner block and to be received in the recess of said opposed surface, said shield being non-porous or impermeable at furnace pressures, across its thickness and said shield extending continuously between said burner block and the surface of said recess and surrounding that part of said burner block received in said recess, whereby said shield being of a fibrous ceramic material effectively prevents the flow of gases in either direction between said block and said casing if the block should crack, and an opening being provided through said casing, said lining, said burner block and said shield for reception of a burner extending therethrough for combustion of fuel within said burner block.

2. The combination of claim 1 in which said shield is made of a fibrous material selected from the group consisting of silicon oxide and aluminum oxide, and a binder.

3. The combination of claim 2 in which said binder is colloidal silica and water.

4. The combination of claim 2 in which starch is provided as an initial binder.

5. The combination of claim 2 in which the shield is from one to two inches thick.

* * * * *